US009709941B2

(12) United States Patent
Kinoshita et al.

(10) Patent No.: US 9,709,941 B2
(45) Date of Patent: Jul. 18, 2017

(54) IMAGE FORMING APPARATUS HAVING A FIXING MEMBER WITH A NIP WHICH CAN BE PRESSED AT DIFFERENT PRESSURE LEVELS

(71) Applicant: Konica Minolta, Inc., Chiyoda-ku, Tokyo (JP)

(72) Inventors: Takeru Kinoshita, Toyokawa (JP); Naoki Kataoka, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/171,242

(22) Filed: Jun. 2, 2016

(65) Prior Publication Data

US 2017/0010574 A1 Jan. 12, 2017

(30) Foreign Application Priority Data

Jul. 9, 2015 (JP) ..... 2015-137863

(51) Int. Cl.
*G03G 15/00* (2006.01)
*G03G 15/20* (2006.01)

(52) U.S. Cl.
CPC ..... *G03G 15/5016* (2013.01); *G03G 15/2085* (2013.01); *G03G 15/70* (2013.01)

(58) Field of Classification Search
CPC ..... G03G 15/2032; G03G 15/2035; G03G 15/70; G03G 21/1685
USPC ..... 399/67, 122, 124
See application file for complete search history.

(56) References Cited

U.S. PATENT DOCUMENTS 7,003,246 B2 * 2/2006 Gogate et al. ..... G03G 15/2035 399/122
8,270,874 B2 * 9/2012 Iwase et al. ..... G03G 15/2035 399/124
9,025,973 B2 * 5/2015 Suzuki et al. ..... G03G 21/1633 399/122

FOREIGN PATENT DOCUMENTS

JP 2001-154526 A 6/2001

* cited by examiner

*Primary Examiner* — William J Royer
(74) *Attorney, Agent, or Firm* — Buchanan Ingersoll & Rooney PC

(57) ABSTRACT

An image forming apparatus includes an image forming unit, a fixing unit, a door, an elastic member to generate a pressing force of a nip portion of the fixing unit, and a switching member to change a pressing state of the elastic member. The switching member is placed in any one of first, second, and third positions. In the first position, the pressing force is defined as a first level. The second position has a second level different from the first level. The pressing force of the third position is equal to or lower than the smaller one of the first and second levels. While the door is closed from open state, an interference member of the door does not interfere with the switching member in the first or second position but interferes with the switching member in the third position to move the switching member to the first position.

6 Claims, 12 Drawing Sheets

IMAGE FORMING APPARATUS HAVING A FIXING MEMBER WITH A NIP WHICH CAN BE PRESSED AT DIFFERENT PRESSURE LEVELS

CROSS-REFERENCE TO RELATED APPLICATIONS

This application is based upon and claims the benefit of priority from the prior Japanese Patent Application No. 2015-137863, filed Jul. 9, 2015, the entire contents of which are incorporated herein by reference.

BACKGROUND OF THE INVENTION

Field of the Invention

The present invention relates to an image forming apparatus including a fixing unit to fix an unfixed toner image onto a recording medium. To be more specific, the invention relates to an image forming apparatus including a fixing unit which is configured to change strength of a pressing force between two nip members (rollers, for example) forming a fixing nip.

Related Art

Heretofore, some image forming apparatuses are configured to change strength of a pressing force between nip members which form a fixing nip. Depending on types of a recording medium to be used, a preferable pressing force at the fixing nip differs. In one example of an image forming apparatus, there set two levels of strength of the pressing force. The stronger pressing force is adopted for a plain paper and the weaker pressing force is adopted for special recording media including an envelope. An image forming apparatus in another example is configured to switch the pressing force as similar to the above example so that the image forming apparatus is not entered into a delivery stage under the strong pressing force.

Patent Document 1 discloses one example of a fixing device configured to switch the pressing force. The fixing device of Patent Document 1 includes "a switching member" to switch the press-contact condition of "a fixing roller." The switching member is configured to be in three positions of "a copying position," "a jam clearing position," and "a press-contact releasing position for delivery." The fixing roller is under press-contact state in the copying position and released from press-contact state in the jam clearing position and in the press-contact releasing position for delivery. The image forming apparatus is provided with a cover to close and open for coping with a paper jamming. This cover can be closed in the copying position and in the press-contact releasing position for delivery, but cannot be closed in the jam clearing position. When the cover is closed while the switching member is in the press-contact releasing position for delivery, the fixing roller at a delivery stage is free from pressing.

RELATED ART DOCUMENTS

Patent Documents

Patent Document 1: JP-A-2001-154526

SUMMARY OF INVENTION

Problems to be Solved by the Invention

However, the above-mentioned prior art has the following problem. When the paper jamming occurs during image forming, naturally, an operator opens the cover and switches the switching member to the jam clearing position to remove the jammed (clogged) paper. To restart image forming thereafter, the switching member has to be returned to the copying position so that the cover is closed. However, the operator often forgets returning the switching member back to the copying position and tries to close the cover. In this case, the cover cannot be closed as mentioned above. Therefore, the operator once stops trying to close the cover, operates the switching member, and closes the cover again. This operation process is complicated.

Another problem is a possibility that the operator wrongly operates the switching member to be in the press-contact releasing position for delivery instead of the copying position. The cover can be closed even in the press-contact releasing position, and if the image forming is performed with this wrong position, a fixing failure could occur. For preventing such a problem, a mechanism to prevent unnecessary switching from the jam clearing position to the press-contact releasing position for delivery has to be provided, but introduction of such a mechanism leads to complication of an image forming apparatus. This problem basically applies similar to an image forming apparatus including a fixing roller configured to be pressed in the press-contact releasing position for delivery or the corresponding position with a pressing force weaker to some extent than in the copying position.

The present invention has been made in view of the circumstances to solve the above problems and has a purpose to provide an image forming apparatus enabled to smoothly restart an image forming operation after clearing a jam.

Means of Solving the Problems

To achieve the above purpose, one aspect of the invention provides an image forming apparatus including: an image forming unit to carry a toner image on a recording medium; a fixing unit to fix the toner image on the recording medium having passed the image forming unit; and a door having a closed state to cover the fixing unit and an open state to expose the fixing unit, the fixing unit including a first nip member and a second nip member pressed against the first nip member, the fixing unit being configured to pass the recording medium between the first nip member and the second nip member to fix the toner image, wherein the image forming apparatus further includes: an elastic member to press the second nip member against the first nip member; and a switching member to change a pressing state of the second nip member pressing the first nip member by the elastic member, the switching member is configured to be switchable in positions of: a first position to press the second nip member against the first nip member with a pressing force at a first level; a second position to press the second nip member against the first nip member with a pressing force at a second level which is different from the first level; and a third position to press the second nip member against the first nip member with a pressing force equal to or lower than the smaller one of the first level and the second level, the door is provided with an interference member configured to be out of contact with the switching member in the first position or in the second position and interfere with the switching member in the third position to move the switching member to the first position while the door is being transferred from the open state to the closed state.

In the above image forming apparatus, if the first position of the switching member is defined as a position for image forming of a plain paper, the second position can be defined as a position for image forming of a special paper. As an alternative, the second position may be a position for delivery. In this case, the pressing force of the second nip member against the first nip member may be zero. Further, the third position of the switching member may be a position for operation such as a jam clearing. The pressing force of the second nip member against the first nip member in the third position may be zero. Typically, it is preferable to make the pressing force in the second position weaker (but not zero) than in the first position, and make the pressing force in the third position zero.

After the switching member is moved to the third position and operations such as a jam clearing is performed, the switching member is manually switched to the first position or the second position and then the door is closed. At this time, the door member can be closed without any obstruction. When the door is about to be closed while the switching member is in the third position, the switching member and the interference member are brought into contact with each other. However, this does not mean that the door cannot be closed. Operation of closing the door moves the switching member to the first position, and accordingly the door can be closed. In this case, the switching member is in the first position, and therefore image forming on the plain paper may be performed.

Effects of the Invention

According to the present configuration, an image forming apparatus enabled to smoothly restart image forming after a jam clearing is provided.

DESCRIPTION OF EMBODIMENTS

Figure 1:
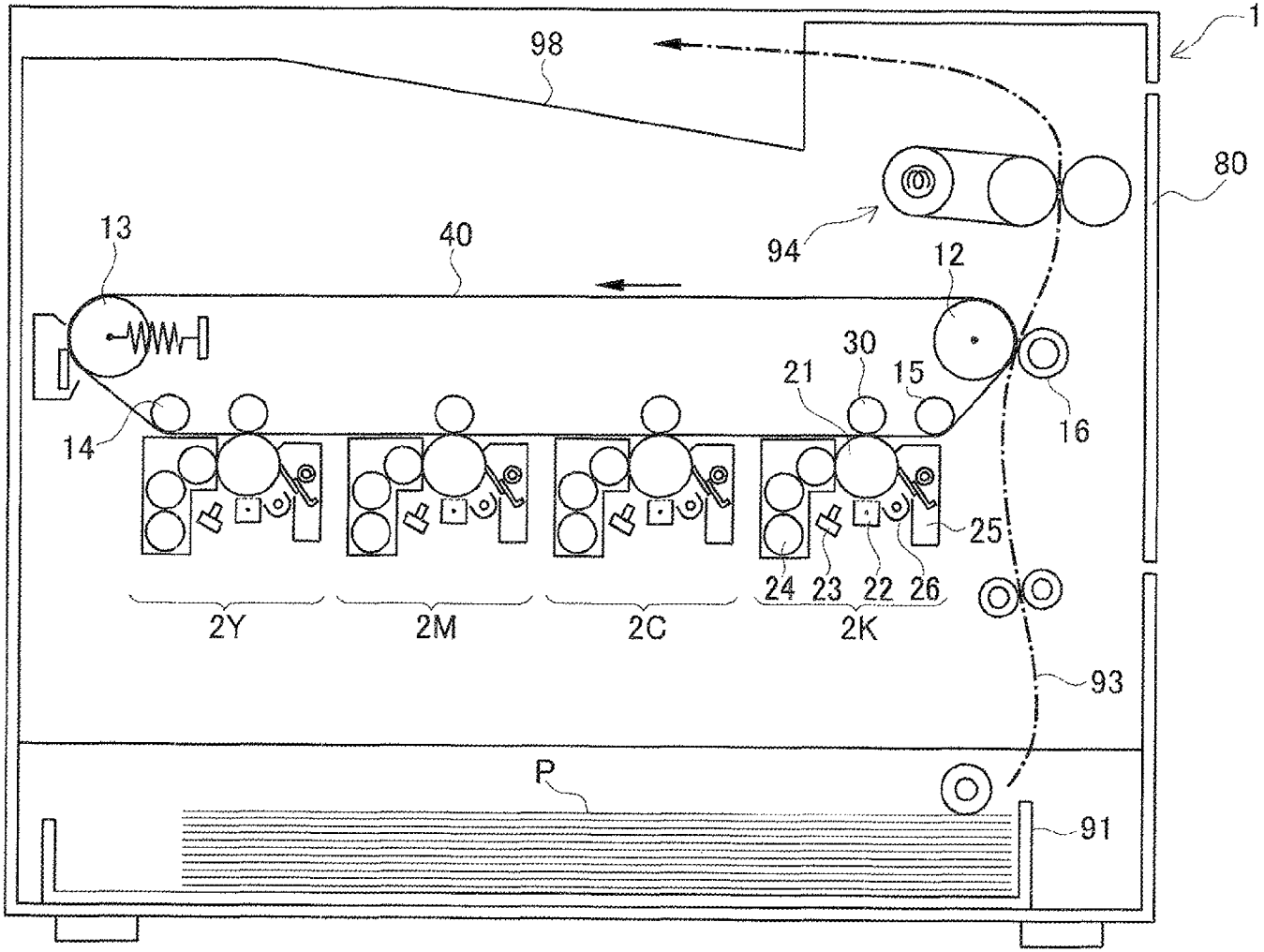
FIG. 1 is a sectional view of an image forming apparatus according to an embodiment.

A detailed description of a preferred embodiment embodying the present invention will now be given referring to the accompanying drawings. FIG. 1 shows one configurational example of an image forming apparatus 1 according to the invention. The image forming apparatus 1 shown in FIG. 1 is a tandem electrophotographic digital color printer (hereinafter, simply described as a "printer"). Other than a printer, the present invention is unquestionably applicable to a multifunction printer including a scanner, a multifunction apparatus having functions of a printer and a scanner, and the like.

The image forming apparatus 1 is provided with an intermediate transfer belt 40 in an almost center portion inside the image forming apparatus 1. The intermediate transfer belt 40 is hung around a drive roller 12, a tension roller 13, and driven rollers 14 and 15. The intermediate transfer belt 40 is configured to rotate in a counter-clockwise direction in FIG. 1 in association with rotation of the drive roller 12. Under the intermediate transfer belt 40, four imaging units 2Y, 2M, 2C, and 2K each corresponding to colors of yellow (Y), magenta (M), cyan (C), and black (K) are placed. The imaging unit 2K includes a photoconductor 21, a charging device 22, an exposing device 23, a developing device 24, a cleaning device 25, an eraser (an image erasing device) 26, and a primary transfer roller 30. Each of the image forming units 2Y, 2M, and 2C has the same configuration with the imaging unit 2K. These imaging units 2Y, 2M, 2C, and 2K are thus configured to form a full-color toner image on the intermediate transfer belt 40. Further, a secondary transfer roller 16 is press-contacted with a portion supported by the drive roller 12 of the intermediate transfer belt 40.

In a lower part of the image forming apparatus 1, a sheet feeding cassette 91 is removably disposed. A paper P as a recording medium is taken out one by one from the sheet feeding cassette 91 and supplied to the secondary transfer roller 16 through a conveying path 93. The paper P supplied to the secondary transfer roller 16 gets transferred with a toner image. Thus, the toner image is carried on the paper P. A fixing unit 94 is placed downstream of the secondary transfer roller 16 (in an upper portion in FIG. 1) on the conveying path 93. The fixing unit 94 is a device to fix an unfixed toner image on the paper P. On a further downstream side of the fixing unit 94, a discharging tray 98 is provided.

Figure 2:
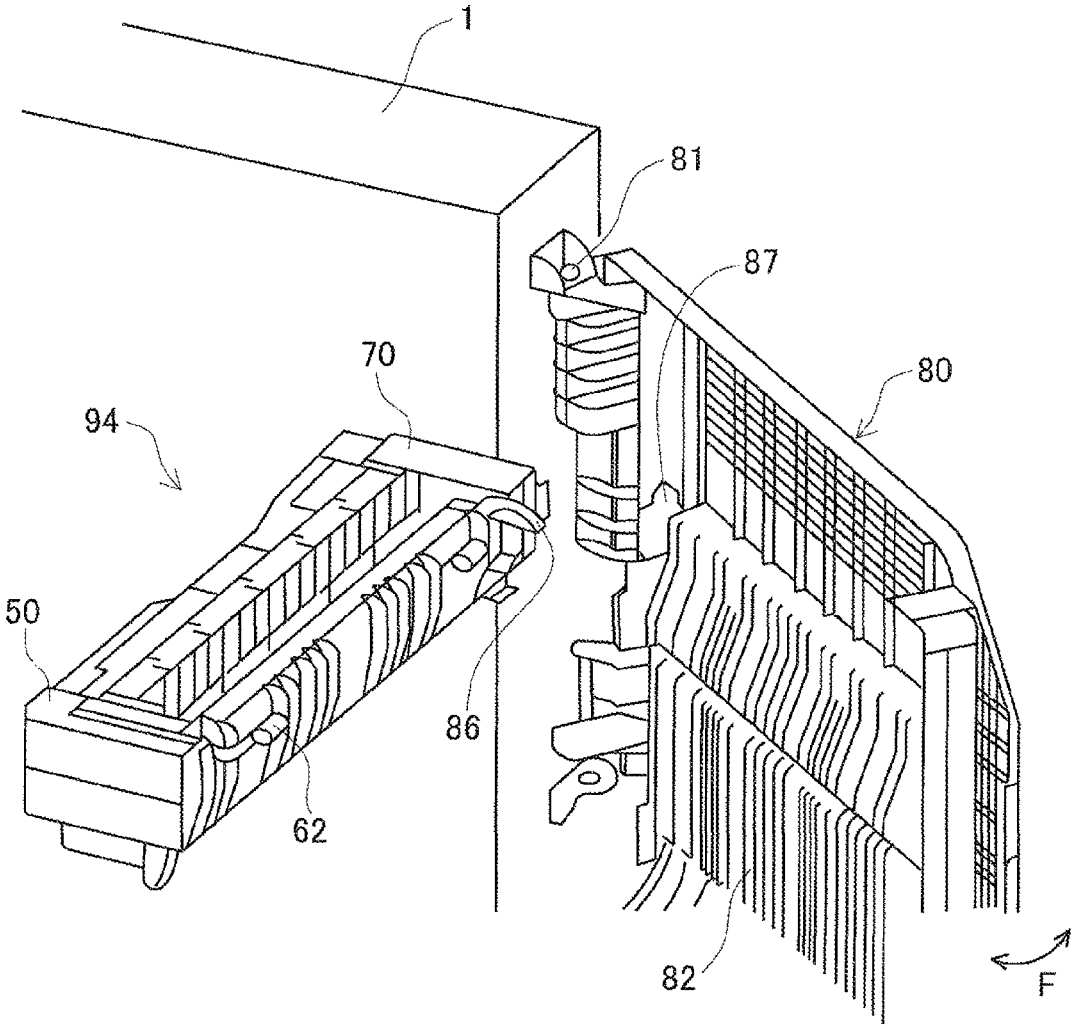
FIG. 2 is a perspective view of a fixing unit and its surroundings while a door is open.

A door 80 configured to open and close is provided in the image forming apparatus 1 on a right-side face in FIG. 1. The fixing unit 94 is placed just inside the door 80. FIG. 2 is a perspective view showing the door 80 in an open state. FIG. 2 shows the door 80 and the fixing unit 94 of the image forming apparatus 1 while the door 80 is open. As shown in FIG. 2, the door 80 is configured to rotate (as indicated with an arrow F) to open or close about a rotary shaft 81 provided in a vertical direction in the image forming apparatus 1. When the door 80 is closed, the fixing unit 94 is covered by the door 80. When the door 80 is open, the fixing unit 94 is exposed. The rotary shaft 81 is placed on a rear side of the image forming apparatus 1. An inner face 82 of the door 80 works as a guide of the paper P conveyed through the conveying path 93 shown in FIG. 1. Further, an engagement member 87 is provided in the inner face 82 of the door 80. The engagement member 87 will be explained later.

Figure 3:
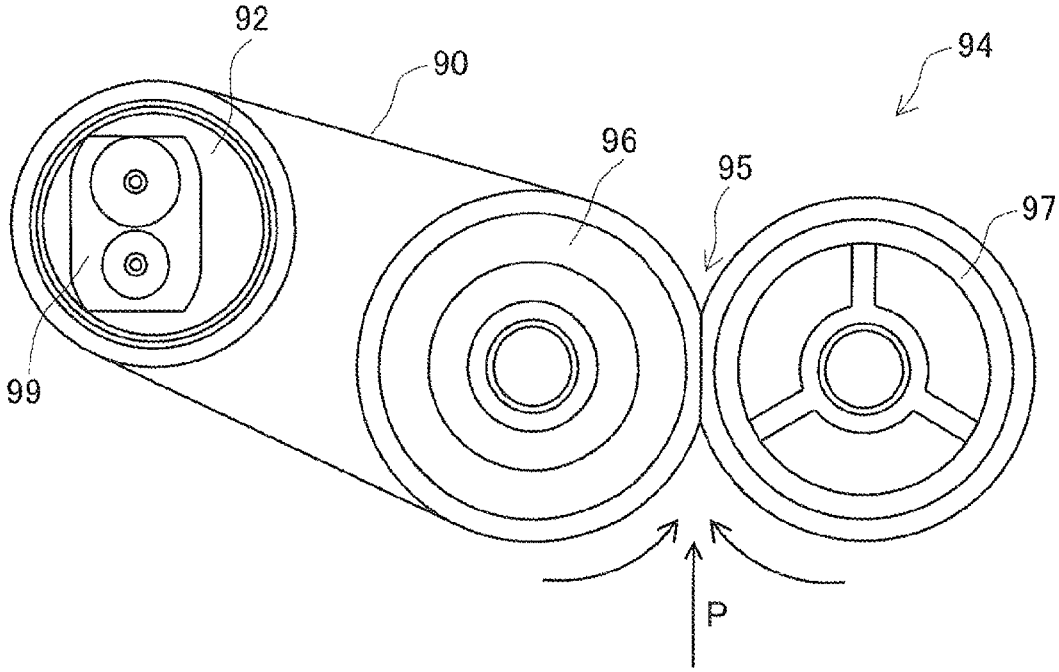
FIG. 3 is a sectional view of the fixing unit in the image forming apparatus shown in FIG. 1.

The fixing unit 94 is now explained. FIG. 3 is a sectional view of the fixing unit 94. As shown in FIG. 3, the fixing unit 94 includes a pressure roller 97, sometimes referred to as a second nip member, a fixing roller 96, sometimes referred to as a first nip member, and a heating roller 92. The pressure roller 97 and the fixing roller 96 are press-contacted with each other to form a fixing nip 95. A fixing belt 90 is hung around the fixing roller 96 and the heating roller 92. The heating roller 92 includes a heater 99. The heater 99 is a heating member such as a halogen lamp, for example. By passing through the fixing nip 95, the unfixed toner is fixed on the paper P.

In the image forming apparatus 1, the fixing roller 96 and the heating roller 92 are fixed at their each position. On the other hand, the pressure roller 97 is movable to change strength of a pressing force between the pressure roller 97 and the fixing roller 96. Further, the pressure roller 97 needs to be movable so that the press-contact state can be released in case the paper P gets jammed. This movable mechanism of the pressure roller 97 is explained with reference to FIG. 4 and the following figures.

Figure 4:
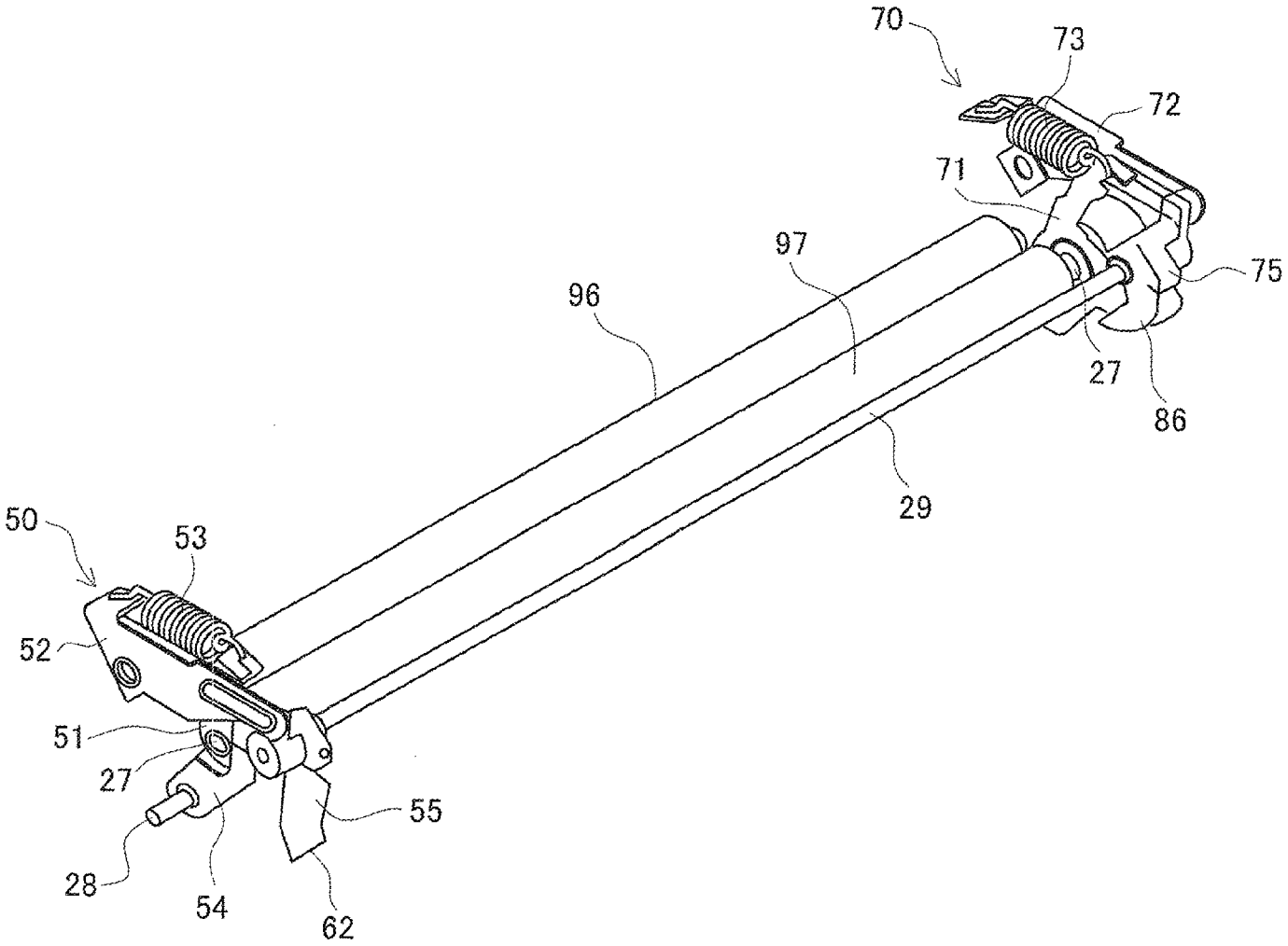
FIG. 4 is a perspective view of a pressure roller and a fixing roller in the fixing unit in FIG. 3.

FIG. 4 is a perspective view of the pressure roller 97 and the fixing roller 96. In FIG. 4, the heating roller 92 and the fixing belt 90 illustrated in FIG. 3 are omitted. As shown in FIG. 4, a holding mechanism 50 and a holding mechanism 70 rotatably support both ends of the pressure roller 97. The holding mechanism 50 and the holding mechanism 70 are configured in an almost reflection symmetry. A shaft 27 of the pressure roller 97 is supported by first movable members 51 and 71 in the holding mechanisms 50 and 70. Both the first movable members 51 and 71 are provided rotatably about a support rod 28. The support rod 28 is statically provided in the image forming apparatus 1 in parallel with the pressure roller 97 and the fixing roller 96. Rotation movement of the first movable members 51 and 71 about the support rod 28 changes strength of the pressing force of the pressure roller 97 to the fixing roller 96 or releases the press-contact state. Herein, a rotation angle of each of the first movable members 51 and 71 may not be large.

The holding mechanisms 50 and 70 are, respectively, further provided with second movable members 52 and 72, first springs 53 and 73, third movable members 54 and 74 (the third movable member 74 is not visible in FIG. 4), and operation members 55 and 75. These and other components will be explained in order. The operation member 55 and the operation member 75 are coupled by a coupling rod 29 to be integrally operated. The coupling rod 29 is statically provided in the image forming apparatus 1 in parallel with the pressure roller 97 and the fixing roller 96. The operation member 55 is provided with a lever portion 62 for manual operation. The operation member 75 is not provided with the lever portion 62. The operation member 55 including the lever portion 62, the coupling rod 29, and the operation member 75 as a whole constitute a switching member.

Figure 5:
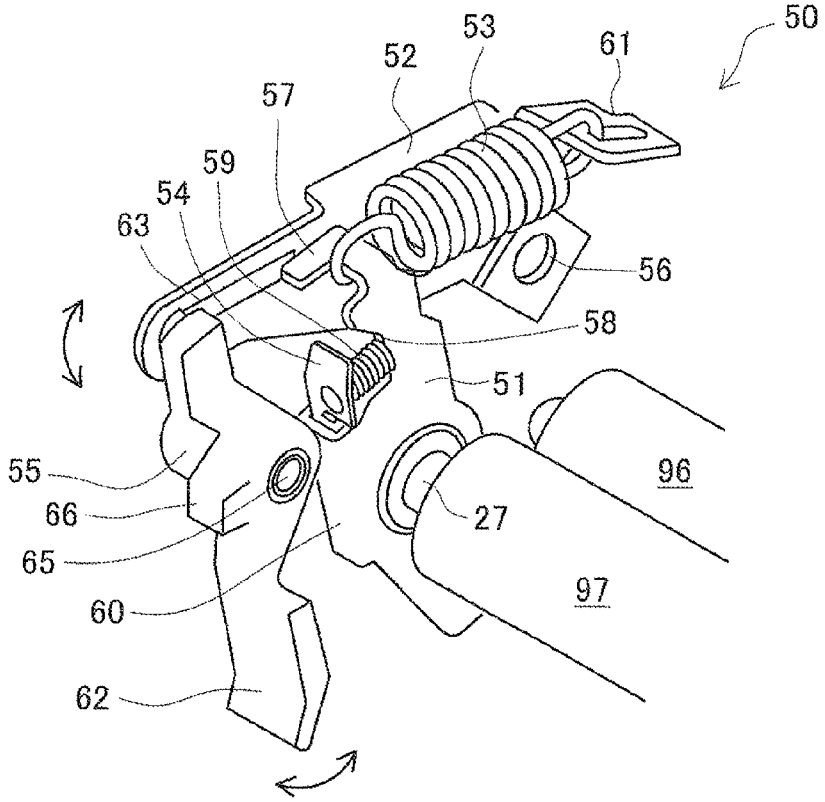
FIG. 5 is a perspective view of a holding mechanism holding one end of the fixing roller of the holding mechanism seeing from inside of a widthwise direction.
Figure 6:
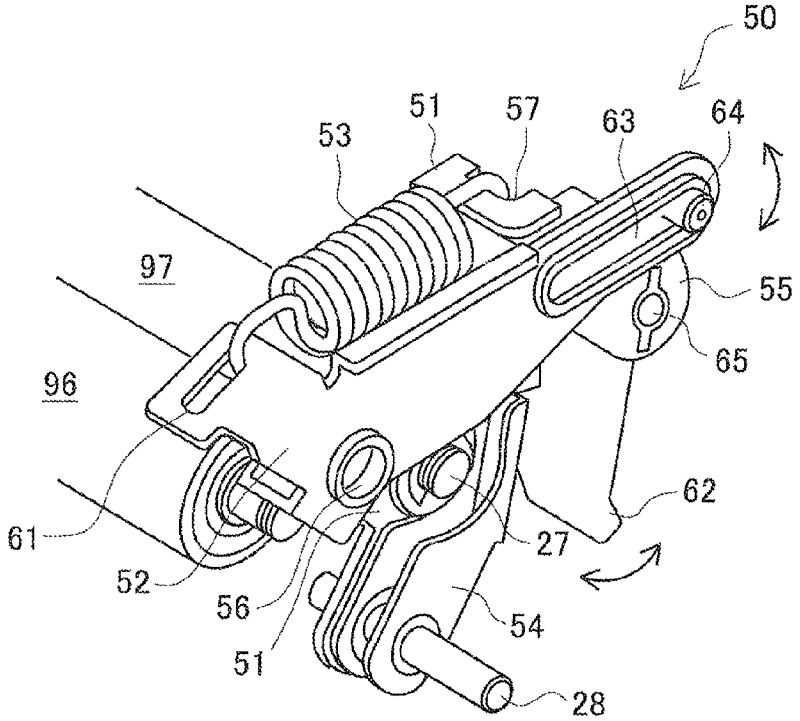
FIG. 6 is a perspective view of the holding mechanism holding one end of the fixing roller of the holding mechanism seeing from outside of the widthwise direction.

The holding mechanism 50 and the holding mechanism 70 are similarly configured (configured in an almost reflection symmetry as mentioned above) except the presence or absence of the lever portion 62 in the operation members 55 and 75. The holding mechanism 50 is further explained in detail with reference to the perspective views of FIGS. 5 and 6. As shown in FIGS. 5 and 6, the first movable member 51 is provided with a spring hook 57. The second movable member 52 is provided with a spring hook 61. Both ends of the first spring 53 are hooked on those spring hooks 57 and 61. Further, the second movable member 52 is provided with a fulcrum 56. The fulcrum 56 is placed in a fixed position in the image forming apparatus 1. The second movable member 52 is configured to rotatably move about this fulcrum 56. Rotation movement of the second movable member 52 changes a distance between the spring hook 57 and the spring hook 61.

To operate the second movable member 52 to rotate, the second movable member 52 is provided with a long hole 63. Further, the operation member 55 is provided with a projecting portion 64. The projecting portion 64 is entered into the long hole 63. Thus, movement of the operation member 55 brings the projecting portion 64 to move in the long hole 63 so that the second movable member 52 is rotated. The operation member 55 is further provided with a rod mounting hole 65. The above mentioned coupling rod 29 is not illustrated in FIGS. 5 and 6, but is mounted in this rod mounting hole 65. Accordingly, the operation member 55 rotates about the rod mounting hole 65. The operation member 55 is rotated by manual operation of the lever portion 62.

The above configuration allows the first spring 53 to be in one state of maintaining its free length and in the other state of being elongated from its free length. In the former state, the first movable member 51 is not subjected to the elastic force of the first spring 53, but in the latter state, the first movable member 51 is pulled by the first spring 53 with its elastic force. A pulling direction coincides with a direction in which the pressure roller 97 is pushed to the fixing roller 96. This state in which the pressure roller 97 is pushed to the fixing roller 96 by the tension of the first spring 53 is defined as a first pressing state.

The first movable member 51 is further provided with a spring seat 58. A second spring 59 is held between the spring seat 58 and the third movable member 54 and contracted from its free length. The second spring 59 is placed in an almost circumferential direction about the support rod 28 of the first movable member 51. The spring seat 58 is placed on a side close to the fixing roller 96 with respect to the second spring 59, and the third movable member 54 is placed on an opposite side from the fixing roller 96. In other words, the third movable member 54 is located far from the fixing roller 96 far more than at least the spring seat 58 of the first movable member 51. The first movable member 51 is further provided with a wall portion 60. The wall portion 60 is located far more than the third movable member 54 from the fixing roller 96. Consequently, the third movable member 54 is placed between the spring seat 58 and the wall portion 60, and the second spring 59 is held between the third movable member 54 and the spring seat 58.

Thus, as long as there is not any special reason, the third movable member 54 is pressed against and stationed at the wall portion 60 by the elastic force of the second spring 59. In this state, the elastic force of the second spring 59 acts on the spring seat 58 and the wall portion 60, and this elastic force is kept in balance between the spring seat 58 and the wall portion 60 inside the first movable member 51. Therefore, the elastic force of the second spring 59 in this state is not exerted on the first movable member 51 to move.

On the other hand, the operation member 55 is provided with a protrusion 66. When the operation member 55 largely rotates, the protrusion 66 pushes the third movable member 54. This pushing force acts in a direction to further compress the second spring 59. By this compression, the elastic force of the second spring 59 is applied not to the wall portion 60 but to the spring seat 58 only in the first movable member 51. As a result, the first movable member 51 is pushed by the elastic force of the second spring 59. The direction of pushing coincides with the direction in which the pressure roller 97 is pressed to the fixing roller 96. This state in which the pressure roller 97 is pressed to the fixing roller 96 by pushing of the second spring 59 is defined as a second pressing state. Herein, the pressing force of the pressure roller 97 against the fixing roller 96 is set larger in the first pressing state than in the second pressing state.

In the first movable member 51, both the spring hook 57 and the spring seat 58 are placed radially outside the shaft 27 of the pressure roller 97 with respect to the support rod 28. Namely, a moving radius of each of the spring hook 57 and the spring seat 58 from the support rod 28 is longer than that of the shaft 27. Therefore, the first spring 53 and the second spring 59 may not be made excessively strong.

Figure 7:
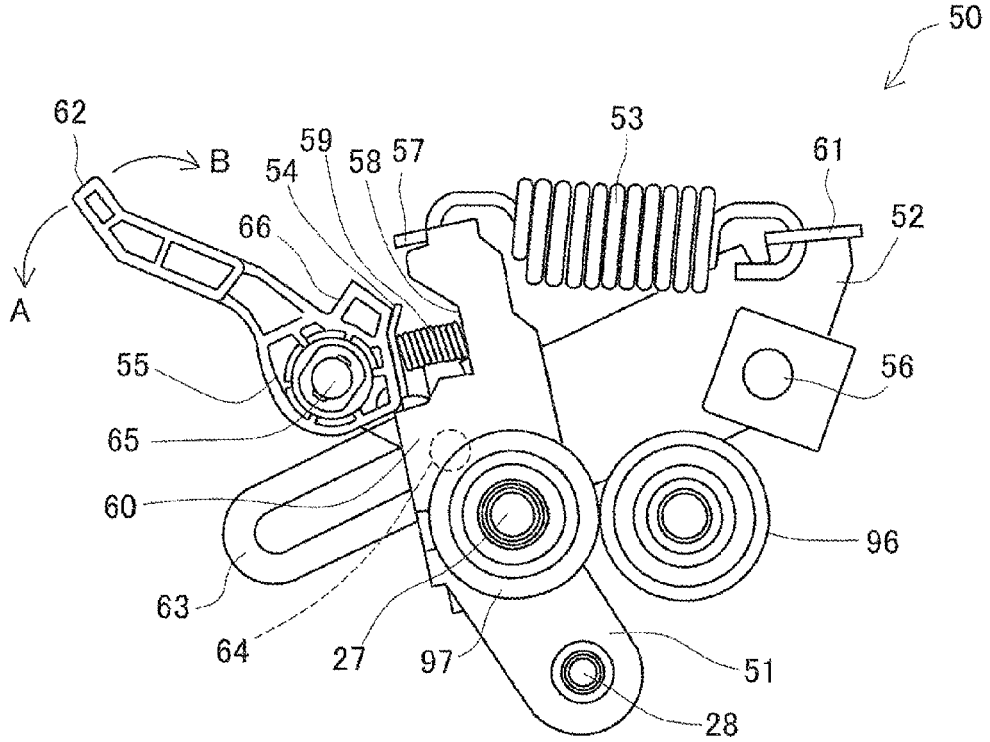
FIG. 7 is a back side view of the holding mechanism shown in FIGS. 5 and 6 when the holding mechanism is seen from a rear side of the image forming apparatus (in a neutral state)
Figure 8:
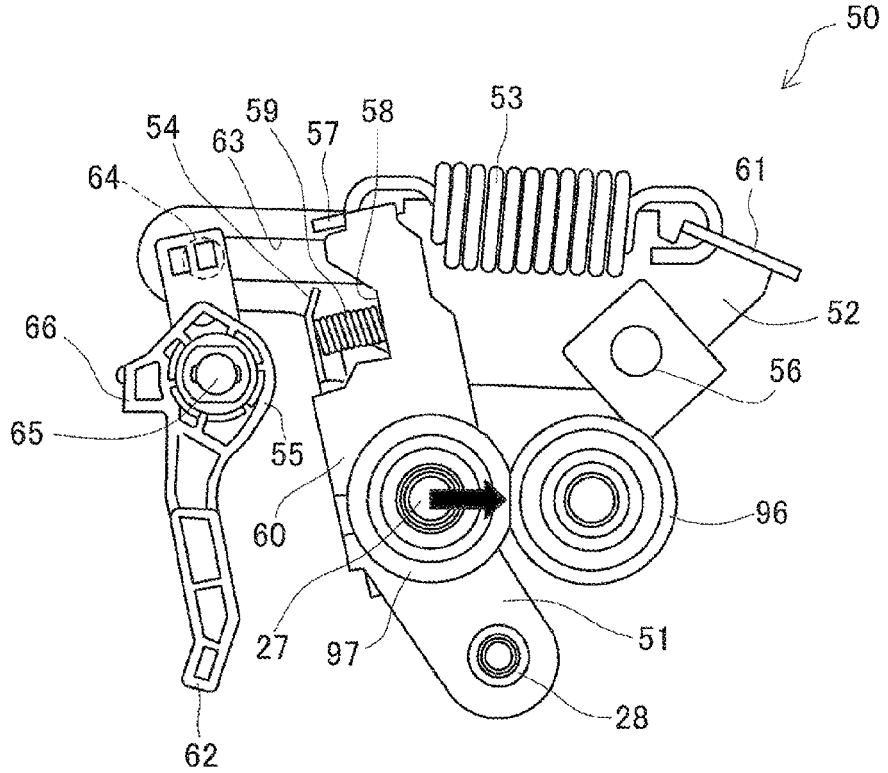
FIG. 8 is a back side view of the holding mechanism seen from the rear side (in a first pressing state)
Figure 9:
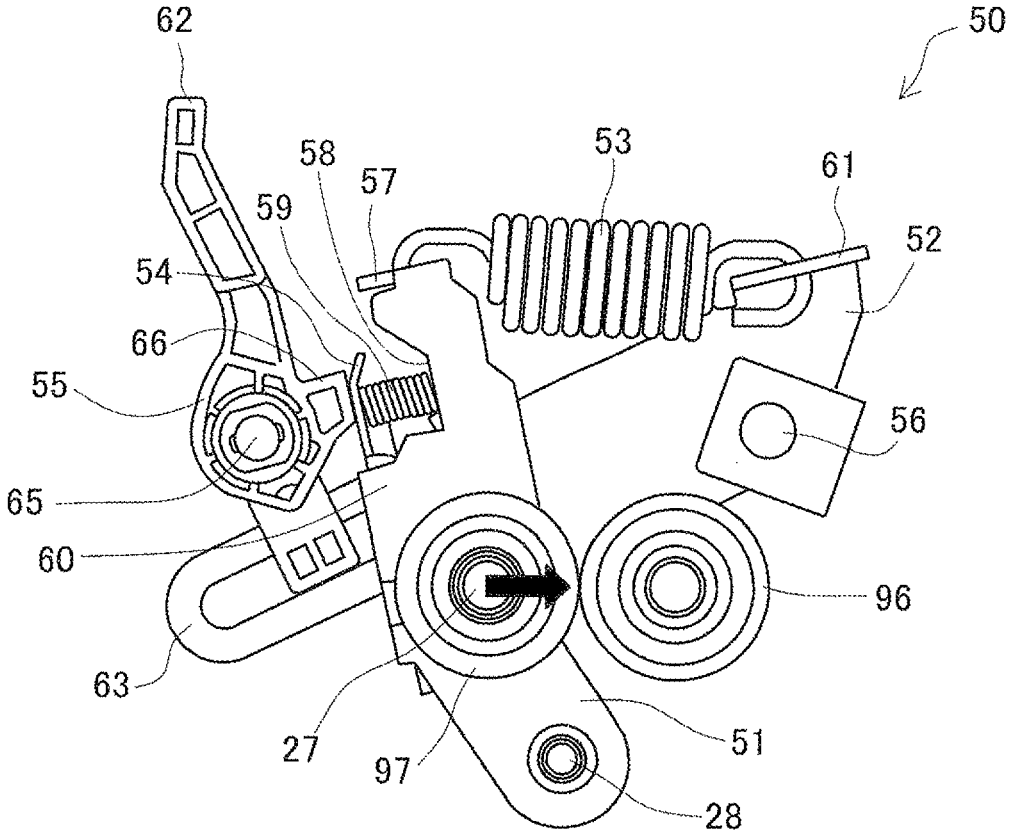
FIG. 9 is a back side view of the holding mechanism seen from the rear side (in a second pressing state)

Operation of the holding mechanism 50 configured above is explained with reference to FIGS. 7 to 9. These drawings illustrate the holding mechanism 50 which is seen from a side of the pressure roller 97 and the fixing roller 96. In other words, the drawings are rear side views of the holding mechanism 50 when the holding mechanism 50 is seen from a rear side of the image forming apparatus 1. FIGS. 7 to 9 are different from one another depending on positions of the operation member 55.

FIG. 7 shows a state in which the operation member 55 is in an intermediate position in its movable range. In this state, the first movable member 51 is free from pressing by any one of the first spring 53 and the second spring 59. In other words, the first spring 53 is not elongated from its free length, and the elastic force of the second spring 59 is made inactive by the contact of the third movable member 54 with the wall portion 60. In the state shown in FIG. 7, therefore, there is applied only little pressing force between the pressure roller 97 and the fixing roller 96. This state is defined as a neutral state, and a position of the lever portion 62 in the state is defined as a neutral position (a third position). The lever portion 62 is operable to move in a direction indicated with an arrow A or a direction indicated with an arrow B from the neutral position.

When the lever portion 62 is operated to move in the arrow A direction from the state shown in FIG. 7, the holding mechanism 50 is set positioned in a state shown in FIG. 8. In the state of FIG. 8, the operation member 55 including the lever portion 62 is in a position rotated nearly by a half rotation in a counter-clockwise direction about the rod mounting hole 65 (the coupling rod 29) from the state shown in FIG. 7. In association with this rotation of the operation member 55, a position of the projecting portion 64 is largely different in FIG. 7 and in FIG. 8. Specifically, the position of the projecting portion 64 is higher in FIG. 8 than in FIG. 7. As a result, the state of the second movable member 52 is also different in FIG. 7 and in FIG. 8. In the second movable member 52 in FIG. 8, the long hole 63 is largely lifted up by the projecting portion 64 from the state shown in FIG. 7. Accordingly, the second movable member 52 in FIG. 8 is, as compared with the second movable member 52 in FIG. 7, rotated in a clockwise direction about the fulcrum 56 in the figure. Herein, an operation force to operate the lever portion 62 to the arrow A direction is not so large because the first spring 53 is not so strong as mentioned above.

Therefore, the spring hook 61 of the second movable member 52 in FIG. 8 is, as compared with the state in FIG. 7, positioned slightly far from the spring hook 57 of the first movable member 51. Accordingly, the first spring 53, which has not been elongated from its free length in FIG. 7, is elongated from its free length in FIG. 8. Thus, unlike the state in FIG. 7, the first movable member 51 in FIG. 8 is urged by contraction of the first spring 53. Therefore, in FIG. 8, the pressure roller 97 and the fixing roller 96 are subjected to the pressing force.

As for the second spring 59, a state shown in FIG. 8 is the same as the state shown in FIG. 7. In the state shown in FIG. 8, only the pressing force generated by the first spring 53 is applied to the pressure roller 97 and the fixing roller 96. The elastic force of the second spring 59 is not applied here. Further, even if an operator releases his hand from the lever portion 62 in the state in FIG. 8, the lever portion 62 does not return to a position in FIG. 7 by itself but remains in a position shown in FIG. 8. This state is appropriate for performing image forming with an ordinarily used printing paper as a paper P (a recording medium). Therefore, usual image forming is performed in this state. This state is the first pressing state, and the position of the lever portion 62 in the state is defined as a first position. The holding mechanism 50 shown in FIGS. 5 and 6 is also in this first pressing state.

When the lever portion 62 is operated in the arrow B direction from the state in FIG. 7, the holding mechanism 50 is set positioned in a state shown in FIG. 9. In the state of FIG. 9, the operation member 55 including the lever portion 62 is slightly rotated clockwise about the rod mounting hole 65 (the coupling rod 29) in the figure from the state in FIG. 7. Accordingly, in the state in FIG. 9, the protrusion 66 of the operation member 55 is positioned to face the third movable member 54. This is a distinguishable feature of the state in FIG. 9 since the protrusion 66 does not face the third movable member 54 in FIGS. 7 and 8. Therefore, as compared with the state in FIG. 7, the second spring 59 is further contracted in the state in FIG. 9. This is because the third movable member 54 is pushed by the protrusion 66 against the spring seat 58 of the first movable member 51. Herein, an operation force required to operate the lever portion 62 in the arrow B direction is not so strong because the second spring 59 is not so strong as mentioned above.

As a result, in the state in FIG. 9, the third movable member 54 is separated from the wall portion 60 of the first movable member 51. In short, the elastic force of the second spring 59 to elongate is applied to the spring seat 58 of the first movable member 51 on one end side, but on the other end side, the force is not applied to the wall portion 60 of the first movable member 51 in the state in FIG. 9. This is because the protrusion 66 receives the urging force of the second spring 59 on the other end side via the third movable member 54. Thus, the first movable member 51 in FIG. 9 is, unlike the state in FIG. 7, urged by the elastic force of the second spring 59. As a consequence, the pressure roller 97 and the fixing roller 96 are subjected to the pressing force, but the pressing force is weaker than that in the state in FIG. 8.

Also in the state in FIG. 9, the first spring 53 keeps its free length as similar to the state in FIG. 7. Namely, the pressure roller 97 and the fixing roller 96 are only subjected to the pressing force generated by the second spring 59 in the state in FIG. 9. The elastic force of the first spring 53 is not exerted in this state. Further, even if the operator releases his hand from the lever portion 62 in the state in FIG. 9, the lever portion 62 does not return to the state in FIG. 7 by itself but remains in a position in FIG. 9. This state in FIG. 9 is appropriate for forming an image on a special recording medium such as an envelope, not an ordinarily used printing paper. Therefore, this state is chosen when image forming is performed for such a special recording medium. This is the second pressing state, and a position of the lever portion 62 in this state is defined as a second position.

The neutral state in FIG. 7 is appropriate for a case of removing a jammed paper P when the paper P gets jammed in the fixing unit 94. When a paper jamming occurs during image forming in the first pressing state in FIG. 8, the lever portion 62 can be operated to shift the state to the neutral state in FIG. 7 without going through the second pressing state in FIG. 9. As similarly, when switching from the second pressing state in FIG. 9 to the neutral state in FIG. 7, the holding mechanism 50 does not go through the first pressing state in FIG. 8. This is because the lever portion 62 in the neutral position is located between the first position and the second position.

As mentioned above, both the second movable member 52 and the third movable member 54 are in the non-operative positions in the state in FIG. 7, and in the state in FIG. 8, only the second movable member 52 is switched to be in the operative position while the third movable member 54 remains in the non-operative position. In the state in FIG. 9, similarly, only the third movable member 54 is switched to be in the operative position while the second movable member 52 remains in the non-operative position.

Figure 10:
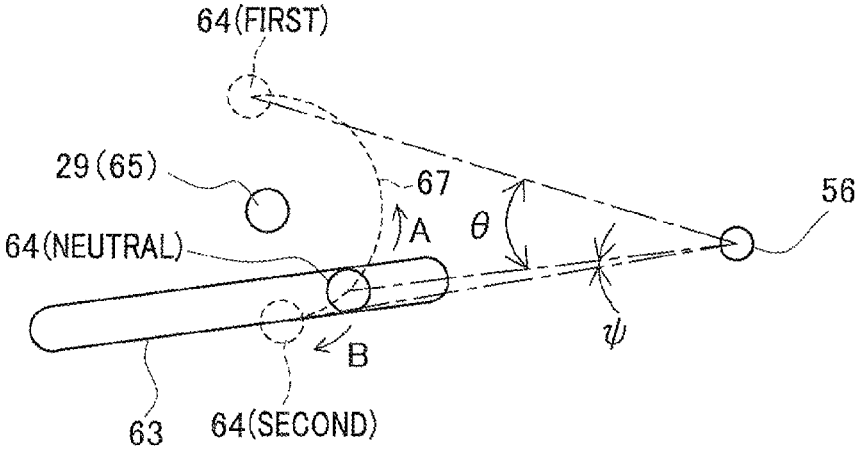
FIG. 10 is a schematic diagram showing a relation between a long hole of a second movable member and a locus of a projecting portion of an operation member.

It is now explained in detail with reference to FIG. 10 the reason why the first spring 53 maintains its free length without being elongated when the lever portion 62 is switched from the neutral position in FIG. 7 to the second position in FIG. 9. FIG. 10 shows a position of the long hole 63 of the second movable member 52 in the neutral state and positions of the projecting portions 64 of the operation member 55 in each state. A locus 67 of the projecting portion 64 depicted by operation of the lever portion 62 is a circular arcuate shape about the coupling rod 29 (the rod mounting hole 65). In the figure, a direction A to move the projecting portion 64 from the neutral position to the first position and a direction B to move the projecting portion 64 to the second position are opposite to each other. Viewing from a point of the fulcrum 56 of the second movable member 52, the first position of the projecting portion 64 is pretty far in an angle from the neutral position (an angle $\theta$ is large to some extent), but the second position is oriented in an almost same angle with the neutral position (an angle $\psi$ is smaller than the angle $\theta$). Positions of each component such as the coupling rod 29 and the fulcrum 56 are set to realize this relation. Accordingly, even when the lever portion 62 is moved from the neutral position to the second position, a rotation angle of the second movable member 52 rotated by that movement of the lever portion 62 is too small to change the state of the first spring 53.

Figure 11:
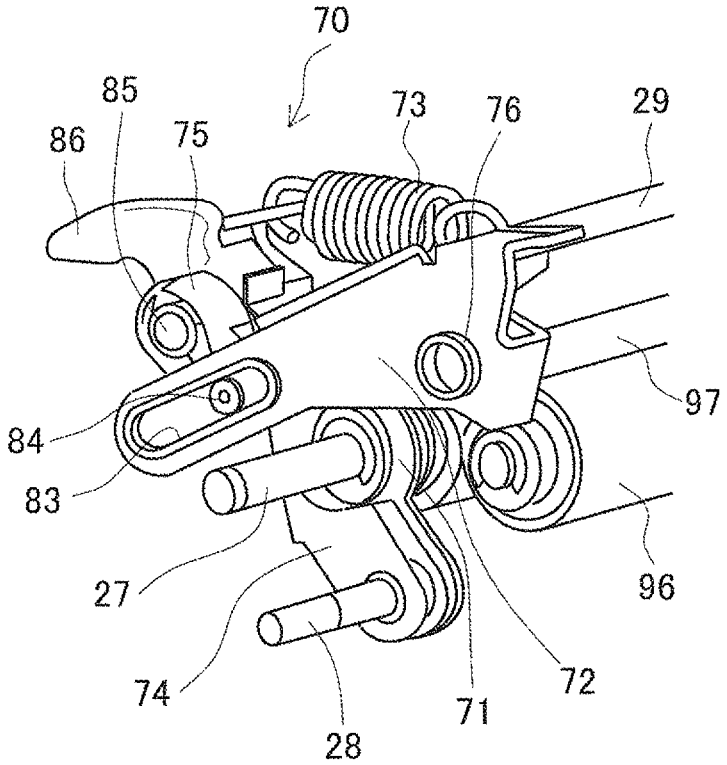
FIG. 11 is a perspective view of a holding mechanism holding the other end of the fixing roller of the holding mechanism seeing from outside of the widthwise direction.

As mentioned above, the holding mechanism 70 is configured in a reflection symmetry with the holding mechanism 50 except the absence of the lever portion 62. The operation member 75 of the holding mechanism 70 is provided with a switching cam 86 instead of the lever portion 62 (see FIG. 4). FIG. 11 is a perspective view of the holding mechanism 70. As shown in FIG. 11, the second movable member 72 is provided with a fulcrum 76 and a long hole 83 as similar to the second movable member 52. Further, the operation member 75 is provided with a projecting portion 84 and a rod mounting hole 85. Thus, the holding mechanism 70 is operated similarly to and synchronously with the holding mechanism 50.

The holding mechanism 70 in FIG. 11 is a state in which the holding mechanism 50 is in the neutral state in FIG. 7, that is, the holding mechanism 70 in FIG. 11 is also in the neutral state. When the holding mechanism 50 is in the first pressing state as shown in FIG. 8, the holding mechanism 70 is also in the first pressing state, and the switching cam 86 is positioned lower than the position indicated in FIG. 11. When the holding mechanism 50 is in the second pressing state as shown in FIG. 9, the holding mechanism 70 is also in the second pressing state, and the switching cam 86 is positioned higher than the position indicated in FIG. 11. This switching cam 86 is located close to the engagement member 87 on the inner face 82 of the door 80 shown in FIG. 2. To be more specific, the engagement member 87 is provided to have a chance of interfering with the switching cam 86 depending on the position of the switching cam 86 while the door 80 is being closed. The engagement member 87 provided in this position is located very close to the rotary shaft 81 of the door 80.

A relation of the holding mechanisms 50 and 70 and the door 80 is now explained. As shown in FIG. 2, the fixing unit 94 is placed to become visible by opening the door 80 on the right-side face of the image forming apparatus 1. In the fixing unit 94, each of the pressure roller 97, the fixing roller 96, the coupling rod 29, and others is placed in a horizontal and a front-rear direction. According to this configuration, the coupling rod 29 is not in parallel with the rotary shaft 81 of the door 80. Further, the holding mechanism 50 is placed on a front side and the holding mechanism 70 is placed on a rear side of the image forming apparatus 1. Therefore, when a user (an operator) opens the door 80 for a jam clearing and other reasons, of the lever portion 62 and the switching cam 86, the lever portion 62 is located on a near side and the switching cam 86 is located on a far side from the user.

Accordingly, when the door 80 is opened for the jam clearing, the lever portion 62 on the near side is manually operated to place the holding mechanisms 50 and 70 in the above mentioned neutral state (see FIGS. 7 and 11) so that the user can perform the jam clearing. When the jam clearing is finished, the lever portion 62 is manually operated to return the holding mechanisms 50 and 70 to the original positions (the first pressing state or the second pressing state). Subsequently, the door 80 is closed and image forming is resumed.

Figure 12:
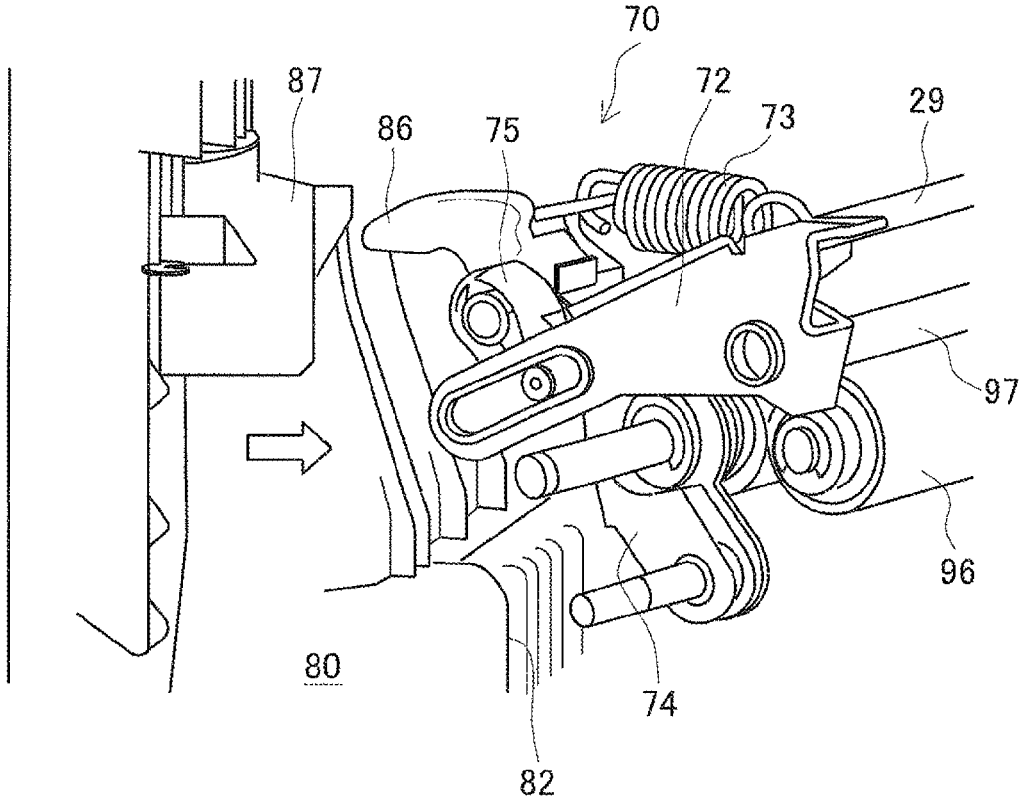
FIG. 12 is a perspective view showing a relation of the door and the holding mechanism in FIG. 11 when the door is about to be closed.

Incidentally, a practical problem is conceivable that the user forgets returning the lever portion 62 to the original position and tries to close the door 80 after the jam clearing operation. The image forming apparatus 1 of the present embodiment is configured to deal with such a case and prevent a larger problem that could be caused in this situation. The following explanation is made for this situation. As shown in FIG. 12, when the door 80 is about to be closed, the engagement member 87 comes close to the switching cam 86. When the holding mechanisms 50 and 70 are in the neutral state, as shown in FIG. 12, the switching cam 86 protrudes to face the engagement member 87.

Figure 13:
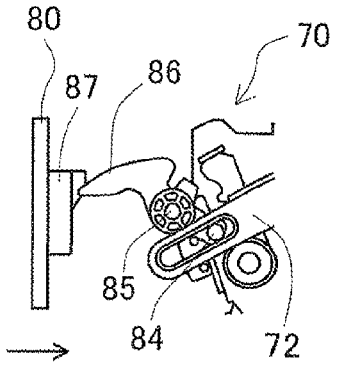
FIG. 13 is a back side elevational view (in a first phase) showing a state in which a switching cam in the neutral position and an engagement member of the door interfere each other.
Figure 14:
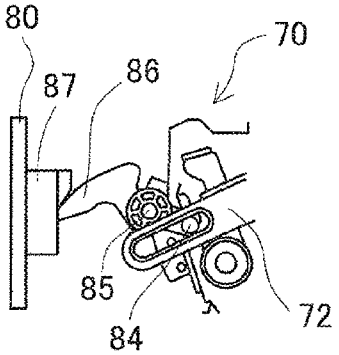
FIG. 14 is a back side elevational view (in a second phase) showing a state in which the switching cam in the neutral position and the engagement member of the door interfere each other.
Figure 15:
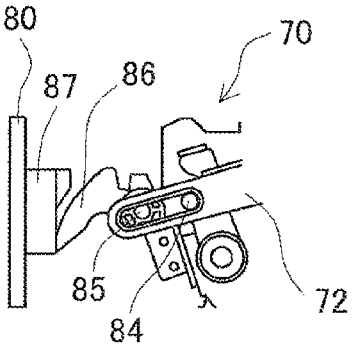
FIG. 15 is a back side elevational view (in a third phase) showing a state in which the switching cam in the neutral position and the engagement member of the door interfere each other.
Figure 16:
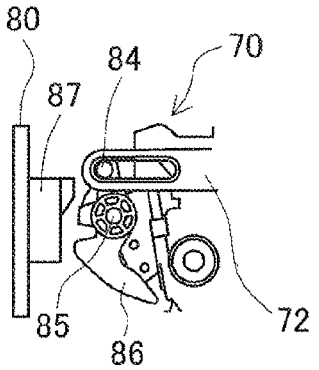
FIG. 16 is a back side elevational view showing the switching cam and the engagement member while the door is completely closed.

As a result, a little before the door 80 is completely closed, the switching cam 86 and the engagement member 87 are brought into contact with each other (see FIG. 13). However, this contact does not obstruct closing of the door 80. When the door 80 is further pushed in a rightward direction in the figure from the state in FIG. 13, as shown in FIG. 14, and then as shown in FIG. 15, the engagement member 87 presses the switching cam 86 to move. Thereby, the door 80 is finally completely closed as the switching cam 86 has faced completely downward as shown in FIG. 16. At the time shown in FIG. 16, the switching cam 86 faces downward, and thus the holding mechanisms 50 and 70 are in the first pressing state shown in FIG. 8. Namely, the holding mechanisms 50 and 70 are in the state appropriate for image forming of an ordinarily used printing paper. Accordingly, even when the door 80 is closed without returning the lever portion 62, image forming can be performed if the printing job is for the ordinarily used printing paper. Through FIGS. 13 to 16, the position of the rod mounting hole 85 (the coupling rod 29) is unchanged.

In the above situation, the movement of pushing the door 80 to close is associated with operation of the switching cam 86. This associated operation does not make the operation of closing the door 80 excessively heavy because of a position of the engagement member 87 provided in the door 80. Specifically, the engagement member 87 is positioned very close to the rotary shaft 81 of the door 80 as mentioned above, whereas the user typically holds a portion around the farthest part from the rotary shaft 81 in the door 80 during opening and closing of the door 80. In view of the lever ratio, pressing of the engagement member 87 against the switching cam 86 does not cause much burden for the user who operates the door 80.

When the lever portion 62 is placed in advance in the first position (the state in FIG. 8) before closing the door 80, naturally, the door 80 is closed without causing interference of the switching cam 86 with the engagement member 87 and the lever portion 62 is brought into the state shown in FIG. 16. In this case, too, image forming of the ordinarily used printing paper can be unquestionably performed.

Figure 17:
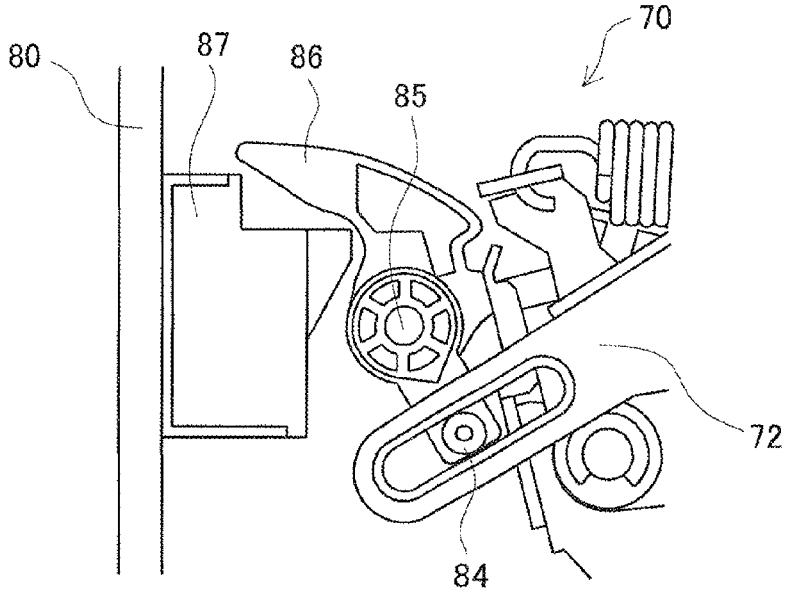
FIG. 17 is a back side elevational view showing a relation between the switching cam in a second position and the engagement member of the door.

When the lever portion 62 is placed in advance in the second position shown in FIG. 9 before the door 80 is closed, the switching cam 86 is positioned higher than the engagement member 87. Accordingly, the door 80 is completely closed without interference of the switching cam 86 with the engagement member 87 as shown in FIG. 17. This state naturally allows appropriate image forming for a special recording medium such as an envelope.

Even in a case that a paper jamming occurs during image forming with the fixing unit 94 in the second pressing state (the state in FIG. 9), the door 80 could be closed without returning the lever portion 62 to the second position after the jam clearing operation. In this case, the fixing unit 94 comes to be placed in the first pressing state (the state in FIG. 8) in the image forming apparatus 1 as mentioned above. However, a problem caused in this case is conceivably small for the following reasons. Firstly, frequency of use of the second pressing state is relatively lower than use of the first pressing state. Secondly, the second pressing state is applied for image forming of a special paper, and thus it is conceivable that a user is highly conscious about operating the image forming apparatus 1.

Figure 18:
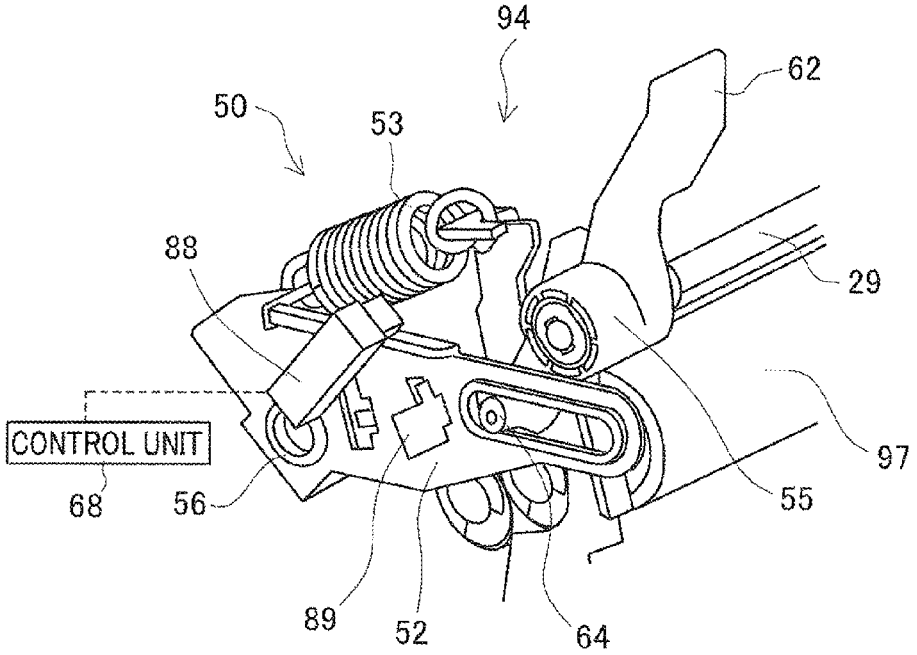
FIG. 18 is a perspective view of the holding mechanism including a detection sensor and the related components to detect a lever position.

To address the above problem, however, the image forming apparatus 1 can provide a configuration to prevent the problem. Specifically, a detection sensor 88 and other components may be provided in the fixing unit 94 as shown in FIG. 18. In an example shown in FIG. 18, the second movable member 52 of the fixing unit 94 (the holding mechanism 50) is provided with a detection member 89. The detection member 89 is configured to move associated with the movement of the second movable member 52. Further, the detection sensor 88 is statically provided in the image forming apparatus 1. The detection sensor 88 is a sensor to output a signal informing whether or not the detection sensor 88 faces the detection member 89. The detection sensor 88 is connected with a control unit 68 in the image forming apparatus 1.

FIG. 18 shows a state in which the lever portion 62 is in the neutral position (the state shown in FIG. 7), and the detection sensor 88 does not face the detection member 89 in this state. In this example, when the lever portion 62 is placed in the first position shown in FIG. 8, the detection member 89 faces the detection sensor 88. When the lever portion 62 is placed in the second position shown in FIG. 9, on the other hand, the detection sensor 88 does not face the detection member 89 which is the same as the state shown in FIG. 18. The example of FIG. 18 is, namely, configured such that the detection sensor 88 detects whether the lever portion 62 is in the first position or out of the first position. In this configuration, when the lever portion 62 is not in the first position while the door 80 is closed, it is determined that the lever portion 62 is in the second position.

The example shown in FIG. 18 is merely one example, and instead of providing the detection member 89 in the second movable member 52, the detection member 89 may be provided in the operation member 55 (including the lever portion 62). In this case, it is possible to configure such that the detection sensor 88 detects whether the lever portion 62 is in the second position or out of the second position. Also in this case, when the lever portion 62 is out of the second position while the door 80 is closed, the lever portion 62 is conceived to be in the first position. Further alternatively, the detection member 89 and the detection sensor 88 may be provided on a side of the holding mechanism 70 instead of a side of the holding mechanism 50.

Specifically, in accordance with the detected state of the detection sensor 88, notification, alarming or control as exemplified below may be performed via the control unit 68.

(1) When the lever portion 62 is in the second position and the door 80 is opened (or a jam occurrence is detected), a display panel of the image forming apparatus 1 shows an instruction to return the lever portion 62 to the original position, namely to the second position and then close the door 80 throughout the term while the door 80 is open. Alternatively, the same instruction may be given by audio output.

(2) When the lever portion 62 is in the second position and the door 80 is once opened and then about to be closed, the detection sensor 88 detects the position of the lever portion 62. In case that the lever portion 62 is not in the original position, i.e., out of the second position, the display panel of the image forming apparatus 1 shows an alarm message. Alternatively, the alarm message may be given by audio output. As another alternative, the image forming apparatus 1 may reject the job of image forming.

Each of the above (1) and (2) may be performed in a case that the original position of the lever portion 62 is the first position.

According to the present embodiment as explained in detail above, the image forming apparatus 1 provided with the fixing unit 94 enabled to switch two levels of pressing forces in the fixing nip 95 is configured such that the pressing force is changed by manual operation of the operation member 55 provided with the lever portion 62. As positions of the lever portion 62 to be operated, the first position and the second position corresponding to the two levels of the pressing force are provided, and other than those, the neutral position to release the pressing force for a jam clearing and other reasons is provided. In occurrence of a paper jamming, the door 80 is opened and the lever portion 62 is set placed in the neutral position for clearing the jam. Herein, the image forming apparatus 1 is configured such that even when the door 80 is about to be closed with the lever portion 62 remained in the neutral position after the jam clearing, the operation member 55 is returned to the first position from the neutral position by the engagement member 87 provided in the door 80. Thus, image forming under a usual condition can be smoothly resumed.

Further, in the image forming apparatus 1, the door 80 is configured as a flap-operation type movable about the rotary shaft 81 on the far side of the image forming apparatus 1. The fixing unit 94 is provided with the holding mechanism 50 on a front side of the image forming apparatus 1 and the holding mechanism 70 on the far side of the image forming apparatus 1, and the holding mechanism 50 includes the lever portion 62. Accordingly, manual operation of the lever portion 62 by the user while the door 80 is open is easy. Further, the holding mechanism 70 is provided with the switching cam 86 which is acted upon by the engagement part 87 when the door 80 is being closed. Therefore, even when the door 80 is closed with the lever portion 62 placed in the neutral position, the operation force to close the door 80 is not so large.

The present embodiment is only an exemplification of the present invention and does not limit the scope of the invention. Accordingly, the present invention may be naturally made various changes and modifications without departing from the scope of the invention. For example, in the above embodiment, the first pressing state (the first position) and the second pressing state (the second position) of the fixing unit 94 are each realized with exclusive springs (the first spring 53 and the second spring 59). The configuration is not limited to this, and two levels of the pressing state may be realized with a common spring.

The present embodiment prescribes the "second position" as a state for printing on special papers in which the fixing nip 95 is pressed with a weak pressing force weaker than a pressing force for the usual printing, but the position is not limited to this. The "second position" may be prescribed as a state for printing on the special papers in which the pressing force is stronger than the pressing force for the usual printing, or a state in which the door 80 is allowed to close with no pressing force subjected for delivery. As another alternative, the "neutral position" may be prescribed as a state in which a very small pressing force is applied within a range not obstructing the jam clearing operation. Further alternatively, the door 80 may be a drawer-type in which the door is opened or closed by a parallel movement. In this case, however, the above mentioned lever effect cannot be achieved. The present invention is also applicable not only to a color printer shown in FIG. 1 but also to a monochrome printer and a copying machine. Further alternatively, the invention may be applied to a multifunction printer having a function of conducting transmission and reception of printing jobs through public lines.

In the image forming apparatus of the present invention, further preferably, the switching member includes: an operation lever, sometimes referred to as a lever portion, to be operated manually by an operator; and an interfered member, sometimes referred to as a switching cam, to be interfered with the interference member, sometimes referred to as an engagement member, and the operation lever and the interfered member are coupled to be synchronously moved. According to this configuration, the operation lever may be formed in a shape appropriate for manual operation by the user and the interfered member may be formed in a shape appropriate for moving by the contact with the interference member.

In the image forming apparatus of the present invention, further preferably, the door is rotated about a rotary shaft to open and close, the switching member includes a coupling rod provided not in parallel with the rotary shaft of the door, the operation lever and the interfered member are provided statically to the coupling rod, and the operation lever is positioned farther and the interfered member is positioned closer from the rotary shaft of the door. This configuration facilitates operation of the operation lever while the door is open. Furthermore, even when the switching member is transferred from the third position to the first position by the closing movement of the door member, the operation force to operate the door is not so heavy.

The image forming apparatus of the present invention further preferably includes a detection sensor to detect whether the switching member is in any one of the first position and the second position; and a control unit configured to perform at least any one of notifying a user and rejecting resumption of image forming in case that a position of the switching member detected by the detection sensor at the time when the door has been once opened and closed is different from that at the time before the door opened. Even when the switching member before opening the door is in the second position, this configuration prevents image forming with the switching member carelessly placed in the first position.

REFERENCE SIGNS LIST

1 Image forming apparatus
2Y, 2M, 2C, 2K Imaging unit
27 Shaft of a pressure roller
28 Support rod
29 Coupling rod
50 Holding mechanism
51 First movable member
52 Second movable member
53 First spring
54 Third movable member
59 Second spring
62 Lever portion
68 Control unit
70 Holding mechanism
71 First movable member
72 Second movable member
73 First spring
74 Third movable member
75 Operation member
80 Door
81 Rotary shaft
82 Inner face of the door
86 Switching cam
87 Engagement member
88 Detection sensor
89 Detection member
94 Fixing unit
95 Fixing nip
96 Fixing roller 97 Pressure roller

What is claimed is:

1. An image forming apparatus including:

an image forming unit to form a toner image on a recording medium;

a fixing unit to fix the toner image on the recording medium having passed the image forming unit; and a door having a closed state to cover the fixing unit and an open state to expose the fixing unit, the fixing unit including a first nip member and a second nip member pressed against the first nip member, the fixing unit being configured to pass the recording medium between the first nip member and the second nip member to fix the toner image, wherein the image forming apparatus further includes:

an elastic member to press the second nip member against the first nip member; and a switching member to change a pressing state of the second nip member pressing the first nip member by the elastic member, the switching member is configured to be switchable in positions of:

a first position to press the second nip member against the first nip member with a pressing force at a first level;

a second position to press the second nip member against the first nip member with a pressing force at a second level which is different from the first level; and a third position to press the second nip member against the first nip member with a pressing force equal to or lower than the smaller one of the first level and the second level, the door is provided with an interference member configured to be out of contact with the switching member in the first position or in the second position and interfere with the switching member in the third position to move the switching member to the first position while the door is being transferred from the open state to the closed state.

2. The image forming apparatus according to claim 1, wherein the switching member includes: an operation lever to be operated manually by an operator; and an interfered member to be interfered with the interference member, and the operation lever and the interfered member are coupled to be synchronously moved.

3. The image forming apparatus according to claim 2, wherein the door is rotated about a rotary shaft to open and close, the switching member includes a coupling rod provided not in parallel with the rotary shaft of the door, the operation lever and the interfered member are provided statically to the coupling rod, and the operation lever is positioned farther and the interfered member is positioned closer from the rotary shaft of the door.

4. The image forming apparatus according to claim 3, further including:

a detection sensor to detect whether the switching member is in any one of the first position and the second position; and a control unit configured to perform at least any one of notifying a user and rejecting resumption of image forming in case that a position of the switching member detected by the detection sensor at the time when the door has been once opened and closed is different from that at the time before the door opened.

5. The image forming apparatus according to claim 2, further including:

a detection sensor to detect whether the switching member is in any one of the first position and the second position; and a control unit configured to perform at least any one of notifying a user and rejecting resumption of image forming in case that a position of the switching member detected by the detection sensor at the time when the door has been once opened and closed is different from that at the time before the door opened.

6. The image forming apparatus according to claim 1, further including:

a detection sensor to detect whether the switching member is in any one of the first position and the second position; and a control unit configured to perform at least any one of notifying a user and rejecting resumption of image forming in case that a position of the switching member detected by the detection sensor at the time when the door has been once opened and closed is different from that at the time before the door opened.

* * * * *